US006512907B2

(12) United States Patent
Nishikawa

(10) Patent No.: US 6,512,907 B2
(45) Date of Patent: Jan. 28, 2003

(54) LIQUID ELECTRO-PHOTOGRAPHIC DEVICE CAPABLE OF PERFORMING OPERATIONAL SEQUENCE INCLUDING CLEANING

(75) Inventor: Hiroshi Nishikawa, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/794,911

(22) Filed: Feb. 28, 2001

(65) Prior Publication Data

US 2001/0026713 A1 Oct. 4, 2001

(30) Foreign Application Priority Data

Feb. 28, 2000 (JP) ..... 2000-050633

(51) Int. Cl.[7] ..... G03G 15/10

(52) U.S. Cl. ..... 399/249; 399/233; 399/237; 15/256.51

(58) Field of Search ..... 15/256.51, 256.52; 399/233, 234, 235, 237, 239, 249

(56) References Cited

U.S. PATENT DOCUMENTS 6,321,054 B1 * 11/2001 Park ..... 399/249

* cited by examiner

*Primary Examiner*—Hoang Ngo
(74) *Attorney, Agent, or Firm*—Young & Thompson

(57) ABSTRACT

An operational sequence including a cleaning of a processing device shifting to the standby state in the process of shifting from a printing operation to a standby state of a liquid electro-photographic device of a tandem type is performed well. A processing device has a squeeze roller for performing removal of residual liquid developer from an image formed on a photoconductive belt 2 and for forming an image into a film and is removed in order that the squeeze roller 6 shifts from the state having a clearance from the photoconductive belt 2 to the state being pressed against the photoconductive belt 2 for performing a removal of the liquid developer remaining on the squeeze roller 6 to the photoconductive belt 2 in sequence when the image forming operation is finished after cleaning the liquid developer adhered on the squeeze roller 6, and the removal proceeds sequentially from a processing device on a downstream side of a traveling direction of the photoconductive belt 2. And the processing device is retracted in order that the squeeze roller 6 shifts from the state having a clearance from the photoconductive belt 2 to the state pressed against the photoconductive belt 2 after performing the removal of the liquid developer remaining on the squeeze roller 6 to the photoconductive belt 2 in sequence, and retraction proceeds sequentially from a processing device on a downstream side before the dirt of the liquid developer removed from the squeeze roller of the processing device on an upstream side to the photoconductive belt 2.

8 Claims, 9 Drawing Sheets

LIQUID ELECTRO-PHOTOGRAPHIC DEVICE CAPABLE OF PERFORMING OPERATIONAL SEQUENCE INCLUDING CLEANING

BACKGROUND OF THE INVENTION

The present invention relates to a liquid electro-photographic device, and more particularly to a liquid electro-photographic device which performs multicolor image formation by providing plural sets of processing device of a liquid developing system therein and image outputs of printers, facsimiles, copiers and the like.

Conventionally, several kinds of systems are used in electro-photographic devices for outputting images of printers, facsimiles, copiers and the like by employing an electro-photographic technology. Among all, a liquid electro-photographic device called a tandem type providing plural sets of processing device of a liquid developing system therein is mostly used as a system for obtaining full-color images with high quality.

The electro-photographic device of the above-mentioned system forms a latent image by charging a surface of a photoconductor of a belt type or a drum type and writing a desired image using laser radiation. And the electro-photographic device develops the latent image by a liquid developer in a processing device. Usually, a full-color image is formed by four-color development providing four sets of processing devices.

A squeeze roller is provided in a processing device and pressed against the photoconductor for removing a residual liquid developer remaining on an image on the photoconductor immediately after a development and performing a conversion into films. The squeeze roller is cleaned when the electro-photographic device shifts to a standby state after finishing an image forming operation. The residual liquid developer still remaining after the cleaning is removed to the photoconductor and cleaned by a cleaning mechanism in the device.

In the above-mentioned prior art, in the event of a tandem type color liquid electro-photographic device, timing at which a second processing device rises (pressing against a photoconductor) is suspended while dirt is passing in the process of removing the dirt from a first processing device to the photoconductor with regard to a processing of a residual liquid developer on a squeeze roller placed in the processing device, when the device shifts to a standby state. In the event of the present sequence, a loss caused by a passing time is raised in the processing devices including a third and a fourth processing devices and a problem is caused that a shifting time for all of the processing devices to a standby state.

SUMMARY OF THE INVENTION

It is therefore an object of the present invention to provide a liquid electro-photographic device capable of performing an operational sequence effectively including cleaning until a standby state of a processing device in the process of shifting from a printing operation to a standby state.

A liquid electro-photographic device of the present invention is a liquid electro-photographic device for forming a multicolor image by liquid processing a latent image on a photoconductor using plural processing devices, in which each of the above-mentioned processing devices has a developing roller for supplying a liquid developer to the above-mentioned photoconductor and a squeeze roller for performing removal of residual liquid developer from an image formed on the above-mentioned photoconductor and for forming an image into a film. And the liquid electro-photographic device is characterized in that the above-mentioned processing device is removed in order that the above-mentioned squeeze roller shifts from the state having a clearance from the above-mentioned photoconductor to the state being pressed against the above-mentioned photoconductor for performing a removal of the liquid developer remaining on the above-mentioned squeeze roller to the above-mentioned photoconductor in sequence when the image forming operation is finished after cleaning the liquid developer adhered on the above-mentioned squeeze roller and the removal proceeds sequentially from a processing device on a downstream side of a traveling direction of the above-mentioned photoconductor.

And the electro-photographic device of the present invention can be characterized in that the above-mentioned processing device is retracted in order that the above-mentioned squeeze roller shifts from the state having a clearance from the above-mentioned photoconductor to the state pressed against the above-mentioned photoconductor after performing the removal of the liquid developer remaining on the above-mentioned squeeze roller to the above-mentioned photoconductor in sequence and retraction proceeds sequentially from a processing device on a downstream side of a traveling direction of the above-mentioned photoconductor.

The electro-photographic device of the present invention can be characterized in that the processing device on a downstream side of a traveling direction of the above-mentioned photoconductor is retracted before the dirt of a liquid developer removed from a squeeze roller to a photoconductor of a processing device on an upstream side of the traveling direction reaches to the processing device on the downstream side.

The electro-photographic device of the present invention can be characterized in providing a squeeze blade for scraping a liquid developer adhered to the above-mentioned squeeze roller off.

The electro-photographic device of the present invention can be characterized in that when the image forming operation is finished, a pressure of the above-mentioned squeeze roller against the above-mentioned photoconductor is reduced to be less than the pressure during an image forming operation in order to clean the liquid developer adhered to the above-mentioned squeeze roller off and the above-mentioned squeeze roller is rotated in a reverse direction against the above-mentioned photoconductor. And the electro-photographic device of the present invention can be characterized in that after the above-mentioned squeeze roller is provided with a clearance to the above-mentioned squeeze blade, the above-mentioned squeeze blade contacts with the above-mentioned squeeze roller and the contact of the above-mentioned squeeze lade with the above-mentioned squeeze roller and the rotation of the above-mentioned squeeze roller are maintained for a certain period of time.

The electro-photographic device of the present invention can be characterized in setting a non-image area unavailable for an image forming in the above-mentioned photoconductor and performing a cleaning by rotating the above-mentioned squeeze roller in a reverse direction against the above-mentioned photoconductor in the above-mentioned non-image area.

The electro-photographic device of the present invention can be characterized in providing a squeeze cleaning roller for scraping the liquid developer adhered to the above-mentioned squeeze roller off.

The electro-photographic device of the present invention can be characterized in providing a cleaning blade for scraping the liquid developer adhered to the above-mentioned squeeze cleaning roller off.

The electro-photographic device of the present invention can be characterized in applying voltage to the above-mentioned developing roller, the above-mentioned squeeze roller and the above-mentioned squeeze cleaning roller, in which the voltage of the above-mentioned squeeze roller is set higher than the above-mentioned developing roller during the image forming operation and the voltage of the above-mentioned squeeze roller is set lower than the above-mentioned developing roller when the liquid developer adhered to the above-mentioned squeeze roller is cleaned off on finishing the image forming operation.

DETAILED DESCRIPTION OF THE PREFERRED EMBODIMENTS

Figure 1:
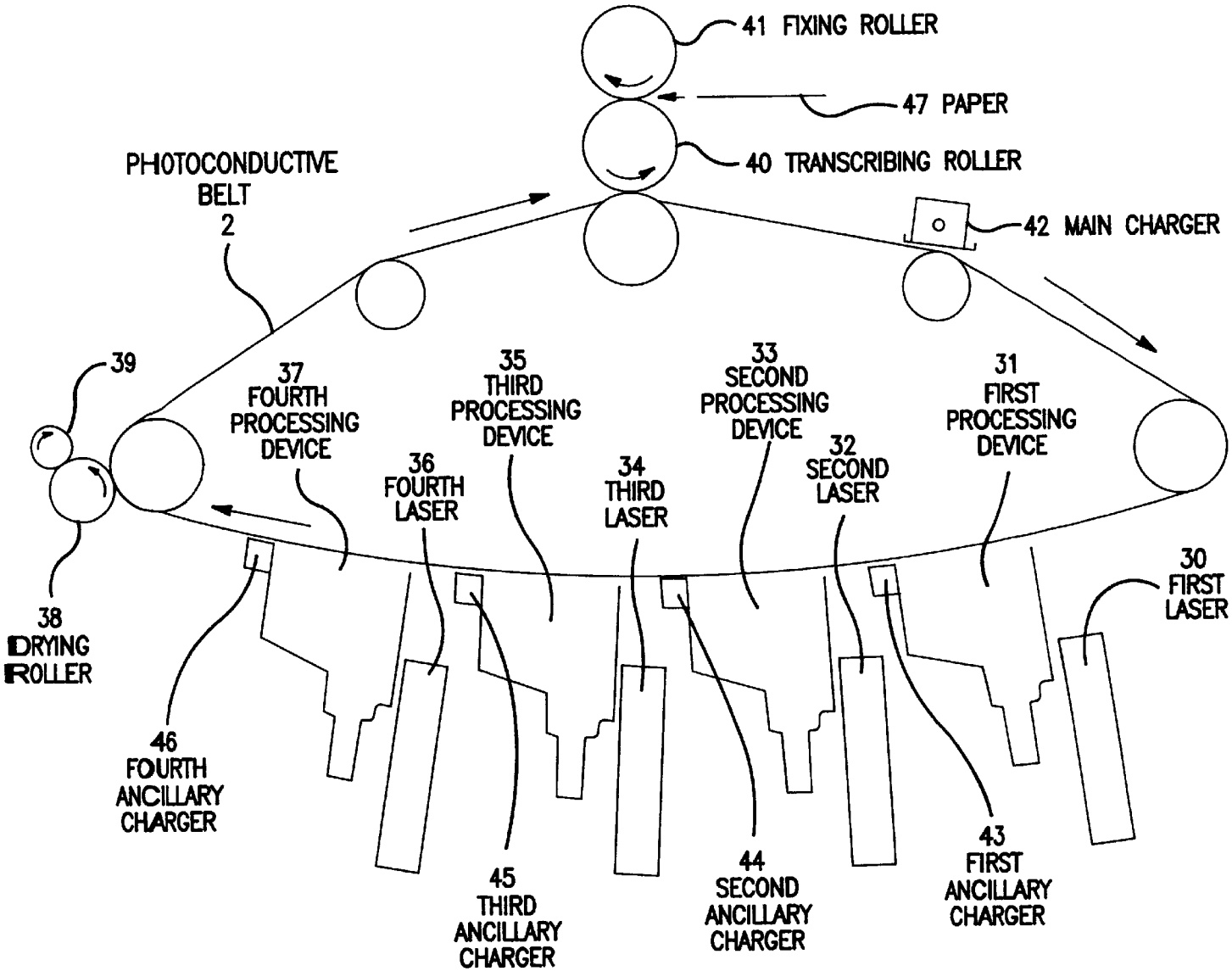
FIG. 1 is a block diagram for showing the whole of a device of the present invention.

Referring now to the drawings, preferred embodiments of the present invention are described more particularly. FIG. 1 is a block diagram for showing the whole of a device of a first embodiment according to the present invention. The first embodiment is an example of a color laser printer.

A first laser 30, a second laser 32, a third laser 34, and a fourth laser 36 are light sources with wavelengths of 660 through 720 nm using a semiconductor laser for forming latent images. An LED (Light Emitting Diode) is acceptable instead of the semiconductor laser. A first processing device 31, a second processing device 33, a third processing device 35, and a fourth processing device 37 develop colors of yellow, magenta, cyan and black respectively, which will be described below.

A photoconductive belt 2 provides a photosensitive layer on a resin film with conductivity on the surface and is formed by sequentially laminating a barrier layer for protecting the photosensitive layer and a release layer for making the liquid developer easier to be separated from the photoconductive belt 2.

A drying roller 38 comprising a metallic cylinder of 20 through 50 mm in diameter coated by a foaming agent thereon has a cylindrical shape with elastic surface coated by silicon and a surface temperature thereon is set between 50 through 100 degrees. The drying roller 38 is pressed with respect to the photoconductive belt 2 with a nip width between 3 through 6 mm and rotates in a same direction as the traveling direction of the photoconductive belt 2 as shown in the diagram. The drying roller 38 is provided for the purpose of raising a solid matter ratio up to 90 through 98 percent by drying a residual electrical insulating liquid included in an image developed by four colors.

A regen roller 39 measures 10 through 30 mm in diameter and comprises the same material as the drying roller 38. The regen roller 39 providing a heat source is pressed with respect to the photoconductive belt 2 with a nip width between 1 through 3 mm and rotates in an opposite direction with respect to the drying roller 38 as shown in the diagram. And a surface temperature is set higher by 10 through 20 degrees than the drying roller 38. The regen roller 39 is provided for the purpose of drying the surface of the drying roller 38 which absorbed the residual electrical insulating liquid and prevent the drying roller 38 from swelling.

A transcribing roller 40 comprising a cylinder of 20 through 50 mm in diameter coated by a rubber material providing elasticity thereon. The transcribing roller 40 providing a heat source has a surface temperature thereon set between 50 through 100 degrees and rotates in a same direction as the traveling direction of the photoconductive belt 2. The transcribing roller 40 is provided for the purpose of transcribing images from the photoconductive belt 2 by being pressed with respect to the photoconductive belt 2 with a nip width of 3 through 6 mm.

A fixing roller 41 is provided for a purpose of fixing the images transcribed to the transcribing roller 40 on papers. The fixing roller 41 having a cylindrical shape consisting of metal provides a heat resource therein and has a surface temperature set 10 through 40 degrees higher than the transcribing roller 40. And the fixing roller 41 is pressed with respect to the transcribing roller 40 with a nip width of 3 through 6 mm and rotates in an opposite direction with respect to the transcribing roller 40 as shown in the drawing.

A main charger 42 is provided for a purpose of charging the photoconductive belt 2 by using chargers such as scotron, crotron, a belt, a roller, a brush and the like and ensuring a surface potential thereon.

A first ancillary charger 43, a second ancillary charger 44, a third ancillary electrifier 45 and a fourth ancillary charger 46 is provided for a purpose of recharging the surface potential on the photoconductive belt 2 depressed after finishing the development by using charger such as, scotron, crotron, a belt, a roller, a brush and the like and ensuring a sufficient surface potential for the next development.

Figure 2:
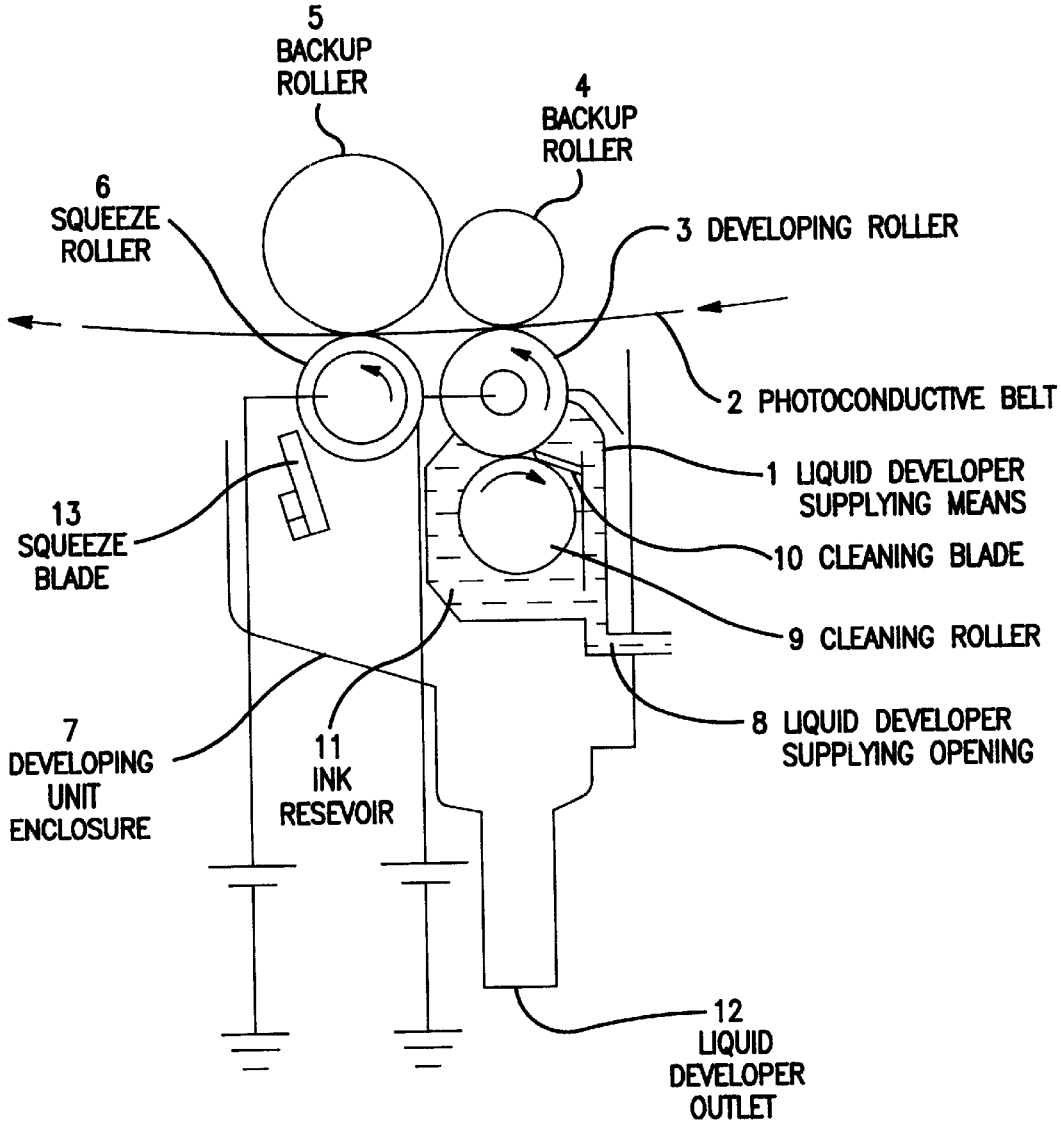
FIG. 2 is a model diagram for showing the processing device of a first embodiment of the present invention, FIGS. 3(*a*) through (*d*) are diagrams for showing the processing device shifting to a standby state of the first embodiment.
Figure 3A:
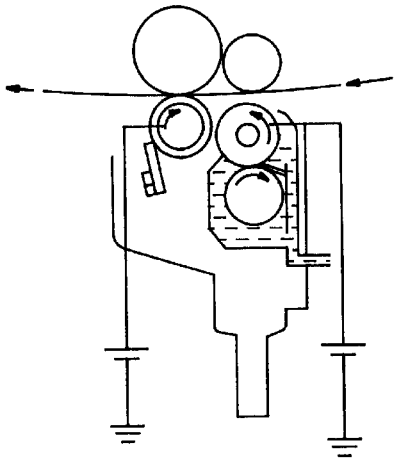
Figure 3C:
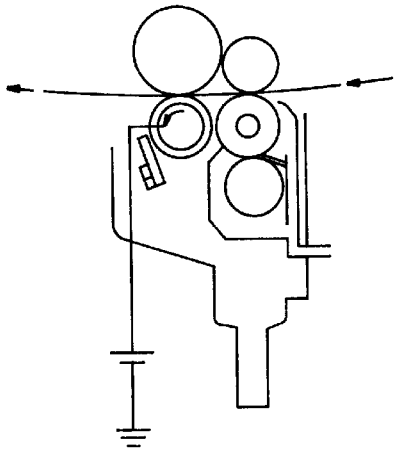
Figure 3B:
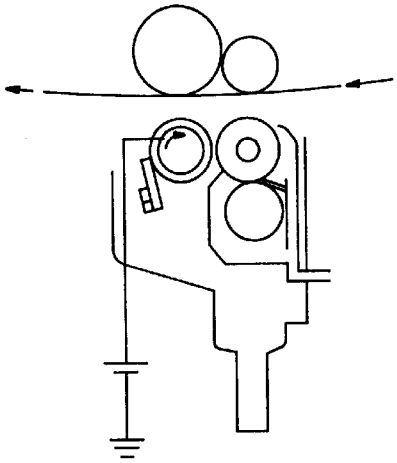
Figure 3D:
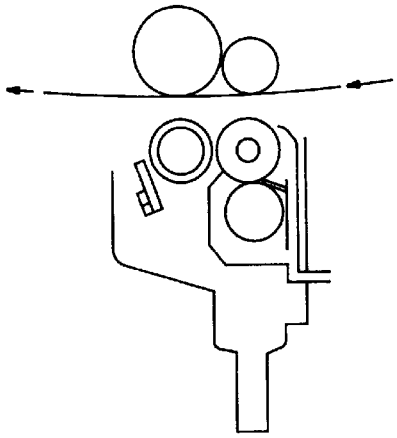

Next, a composition of the processing device is described. All of a first through a fourth processing devices have a similar composition. FIG. 2 is a model diagram of a processing device. A composition of a type of processing device installing a squeeze blade therein in a printing operation is described by using FIG. 2.

A liquid developer supplying member 1 supplies a liquid developer to a developing roller 3. The liquid developer is formed by dispersing a toner of charged particle (hereinafter mentioned as toner) which consists of at least two materials of coloring agent and resin in an electrical insulating liquid. The toner is charged positively in the present invention.

The developing roller 3 is a roller in a cylindrical shape consisting of metals such as aluminum, SUS (stainless) and the like. The developing roller 3 conveys the liquid developer discharged out of the liquid developer supplying member 1 to a developing area having a gap of 0.15 mm between the photoconductive belt 2 and the developing roller 3 by being rotated in a same direction as a traveling direction of the photoconductive belt 2 by a driving system not shown in order to perform developments with respect to the photoconductive belt 2 having latent images thereon. And a voltage providing a potential difference of 300 through 500 V with respect to an exposure potential on the photoconductive belt 2 is applied to the developing roller 3 in order to form an electric field for developments.

A backup roller 4 acts as an opposing roller so that the development gap between the photoconductive belt 2 and the developing roller 3 is maintained invariantly.

The backup roller 5 acts as an opposing roller so that a squeeze roller 6 is pressed against the photoconductive belt 2.

The squeeze roller 6 comprising a cylinder-shaped shaft of aluminum, SUS (stainless) and the like coated by an elastic body consisting of a rubber material presses a both ends holding member not shown with respect to the photoconductive belt 2 by a spring material and is pressed with respect to the photoconductive belt 2 by an adequate amount of pressure between 10 through 30 kg. And the squeeze roller 6 is provided for a purpose of removing the residual liquid developer from an image immediately after development and forming an image into a film by rotating in a same direction with respect to the traveling direction of the photoconductive belt 2.

A direct current voltage is applied to the squeeze roller 6 and a higher voltage of 50 through 200 V is set with respect to the voltage applied to the developing roller 3 during the printing operation.

A liquid developer supplying opening 8 is an inlet provided in a processing device to which the liquid developer is supplied from a liquid developer storage not shown via pipes. The liquid developer supplied from the liquid developer supplying opening 8 fills an ink reservoir 11 up and is supplied to the developing roller 3 via the liquid developer supplying member 1.

A cleaning blade 10 using a material with elasticity therein is pressed with respect to the developing roller 3 by the end portion and cleans the liquid developer adhered on the surface of the developing roller 3 off immediately after developments.

The liquid developer scraped by a cleaning blade 10 is cleaned off by a cleaning roller 9. The cleaning roller 9 is a roller in a cylindrical shape comprising coarse materials such as a foam rubber, brush and the like and is provided for a purpose of cleaning the liquid developer adhered on the cleaning blade 10 by rotating in the opposite direction with respect to the developing roller 3. And the cleaning roller 9 is placed so as to engage with respect to the cleaning blade with depth of 1 through 1.5 mm.

The ink reservoir 11 comprising POM (polyacetal), urethane and the like provides the cleaning roller 9 and the cleaning blade 10 therein and has a composition of being filled up with the liquid developer during a developing operation. The liquid developer scraped by the above-mentioned cleaning blade 10 and cleaned by cleaning roller 9 is mixed with the liquid developer filling inside of the ink reservoir 11 and agitated by the cleaning roller 9 which rotates in a same direction with respect to the developing roller 3 by a driving system not shown in the ink reservoir 11. After that, the liquid developer spills over the ink reservoir 11 and re-conveyed to the liquid developer storage not shown via a liquid developer outlet 12.

A squeeze blade 13 comprising an elastic body as rubber material, and the like stays apart form the squeeze roller 6 during a printing operation. And once the processing device is shifted to a mid step position as shown in FIG. 3, the squeeze blade 13 contacts with the squeeze roller 6 by an end portion and cleans the squeeze roller 6 by scraping the developer adhered on the surface thereof.

All members of the processing device are accommodated in a developing unit enclosure 7. Next, an operation is described. Referring to FIG. 1, an operation in the process of the device shifting to the standby state will be described below.

When the photoconductive belt 2 rotates and reaches to a position of the main charger 42, the surface of the photoconductive belt 2 is positively charged by the main charger 42 in order to ensure the surface potential. And when the photoconductive belt 2 reaches to the first laser 30, a latent image is formed on the surface of the photoconductive belt 2 and potential of the latently imaged portion is depressed.

After obtaining the latent image, the photoconductive belt 2 completes the developing operation in the first processing device 31 through the process of the development, the removal of the residual liquid developer and forming the image into a film, as described in detail below.

Next, the surface of the photoconductor is positively recharged by the first ancillary charger 43 and the surface potential thereof is ensured. In the event of developing successively without ancillary charge, the surface potential depressed lower because of a dark attenuation property and a problem such as texture dirt is raised in the second processing device 33 and following processing devices thereto.

The image formations and the developing operations in the second processing device 33 and the following processing devices thereto are similar to the event of the above-mentioned first processing device 31.

After finishing four color development by passing the fourth processing device 37, the image is conveyed to the drying roller 38 by a rotation of photoconductive belt 2. The residual electrical insulating liquid in the liquid developer is dried by heat and pressure of the drying roller 38 and the ratio of solid matter is raised to 90 through 98 percent in the image on the photoconductive belt 2. After that, the image on the photoconductive belt 2 is separated from the photoconductive belt 2 by the transcribing roller 40 and transcribed to the transcribing roller 40. When the image reaches to the fixing roller 41 while the transcribing roller 40 is rotating, a paper 47 is conveyed from a paper storage not shown and rushed in between the nips of the transcribing roller 40 and the fixing roller 41. Then, the fixing roller 41 separates the image from the transcribing roller 40 and fixes the image on the paper 47.

When the printing operation is finished, each of the processing device shifts to the standby state according to the sequence mentioned below.

Dirt produced on the photoconductive belt 2 at the time is dried by the drying roller 38, removed to the transcribing roller 40 and recovered by a cleaning element not shown. After finishing the recovery, the drying roller 38 and the transcribing roller 40 are retracted by the photoconductive belt 2, the main charger 42 is switched off and the photoconductive belt 2 stops at a predetermined position.

Figure 4:
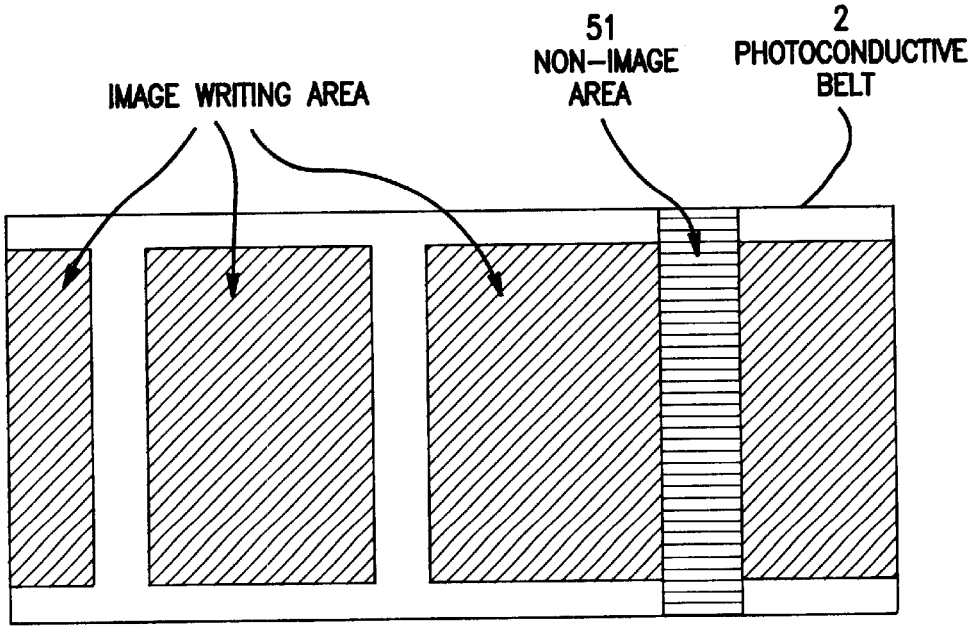
FIG. 4 is a model diagram for showing a configuration of the non-image area on the photoconductive belt.
Figure 5:
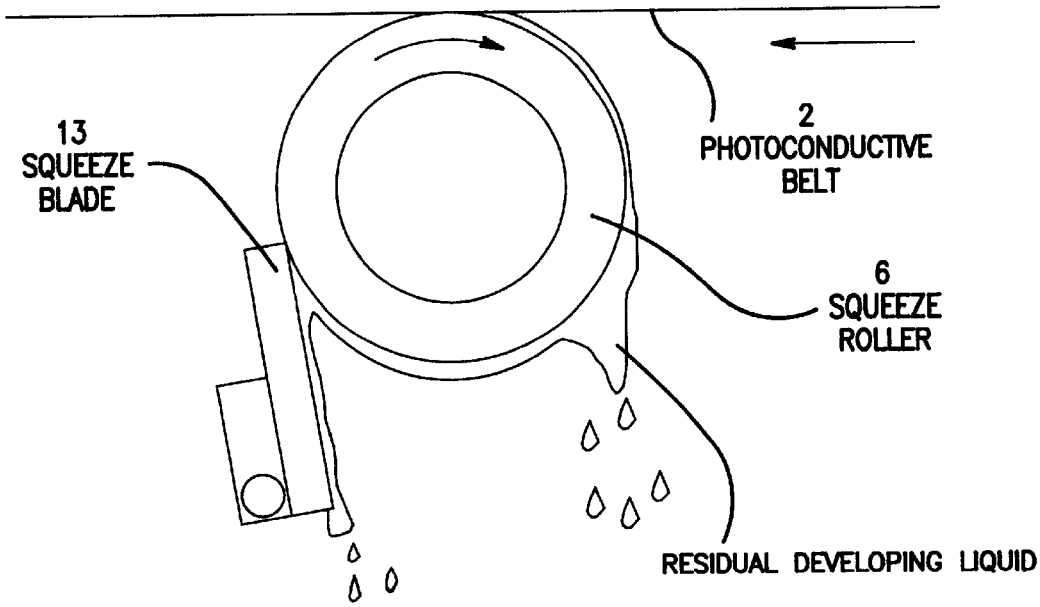
FIG. 5 is a model diagram for showing a cleaning state of the first embodiment.

Next, an operation of the processing device shifting to the standby state is described. As shown in FIG. 4, a non-image area 51 not for writing images in is predetermined in the photoconductive belt 2 and a cleaning operation before the standby state of the processing device is performed in the area.

In the event that the non-image area is not set, in the present embodiment, the surface of the photoconductor in the image area can be damaged and the image quality is possibly lost by a friction rotation of the squeeze roller 6 with respect to the photoconductive belt 2.

FIG. 3 is a diagram for showing the processing device shifting to the standby state. Before the non-image area 51 shown in FIG. 4 reaches to the processing device, a supply of the developer to the processing device is stopped. When the non-image area 51 reaches to the processing device, the processing device shifts from the developing state of FIG. 2 to the mid step position as shown in FIG. 3(*a*). When the processing device shifts to the mid step portion, the squeeze roller 6 starts rotating in a reverse direction with respect to the traveling direction of the photoconductive belt 2 using the driving system not shown. The present operation is for a removal of the developing solution accumulated on the upstream side of the squeeze roller 6. The squeeze roller 6 shifts to the mid step position, because when the squeeze roller 6 is in a developing state of rotating in the reverse direction with respect to the photoconductive belt 2, in which the squeeze roller 6 is pressed with respect to the photoconductive belt 2 at a high pressure of 10 through 30 kg, the squeeze roller 6 increases torque and put a heavy load on the driving system not shown and the photoconductive belt 2. Consequently, the squeeze roller 6 shifts to the mid step position for the purpose of reducing the pressure is reduces to 5 through 10 kg.

And the squeeze blade 13 contacts with the squeeze roller 6 which starts reverse rotation concurrently therewith and cleans the surface of the squeeze roller 6 by scraping the toner adhered thereon.

After a certain period of time since the processing device has shifted from the mid step position, a supply of voltage applied to the developing roller 3 and the ancillary charger is stopped.

And after finishing the cleaning of the developing solution accumulated between the photoconductive belt 2 and the squeeze roller 6, the processing device shifts to the lower step position, as shown in FIG. 3(*b*). At the lower step position, the squeeze blade 13 remains contacting therewith, while the squeeze roller 6 remains rotating. The rotation of the developing roller 3 is stopped.

By the steps of completing cleaning of the squeeze roller 6 sufficiently by the squeeze blade 13, stopping the drive of the squeeze roller 6, separating the squeeze blade 13 from the squeeze roller 6 and raising the processing device to the upper step position (developing position), again so that the squeeze roller 6 contacts with the photoconductive belt 2, the processing device shifts to the state of FIG. 3(*c*). The squeeze roller 6 rotates in a same direction as the traveling direction of the photoconductive belt 2 without providing drive in the upper step position and removes the toner which is adhered to the squeeze roller 6 in the upper step position and is not scraped completely off to the photoconductive belt 2.

After an appropriate interval for the surface of the squeeze roller 6 to be cleaned in the upper step position, the processing device moves to the lower step position without a cleaning operation at the mid step position and shifts to the state shown in FIG. 3(*d*). And after shifting to the lower step position, the voltage applied to the squeeze roller 6 is stopped.

Finally, it comes to an end of a cleaning operation for one set of processing device. The above-mentioned cleaning process of the processing device is performed sequentially from an upstream side of the processing device with respect to the traveling direction of the photoconductive belt 2.

Figure 6:
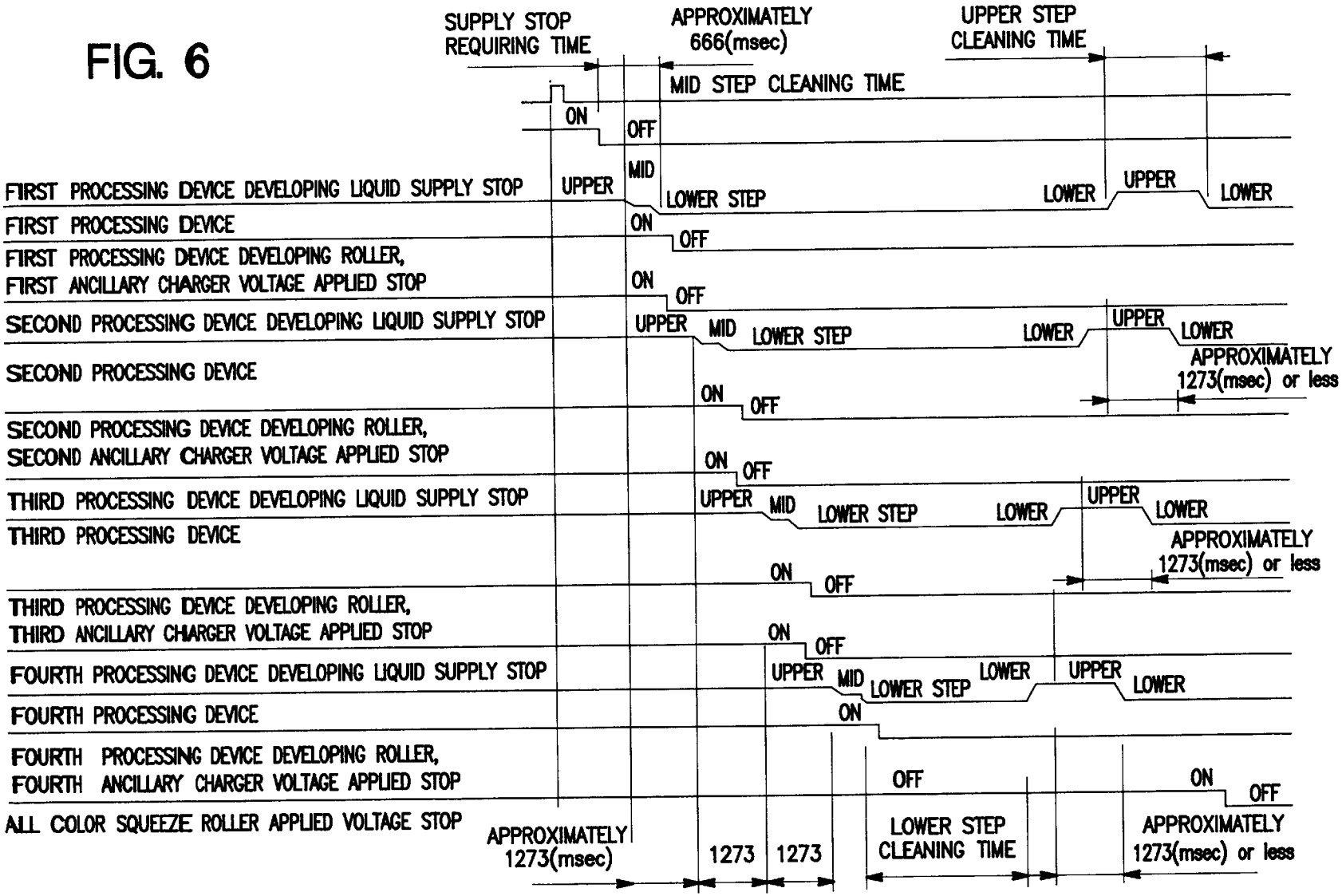
FIG. 6 is a model diagram of an operational sequence of the first embodiment.

A model diagram of each operational sequence in the event of the present embodiment is shown in FIG. 6. The present sequence shows the event that traveling speed of the photoconductive belt 2 is at a 76.2 mm/sec, a distance between each processing device is 97 mm and the length of the non-image area 51 with respect to the traveling direction of the photoconductive belt 2 is 50.8 mm.

When the non-image area 51 shown in FIG. 4 reaches to the first processing device 31, the cleaning operation shown in FIG. 3(*a*) is started. A time earned by subtracting a time required for shifting from upper step via mid step to the lower step from a passing time of the non-image area 51 is equal to the time for cleaning the accumulation of the developing liquid produced between the photoconductive belt 2 and the upstream side of the squeeze roller 6 in the above-mentioned mid step position. In the event of the present embodiment, time of approximately 666 m sec is required for completing the cleaning including the shifting time. The number of revolutions and the pressure of the squeeze roller 6 is set at an appropriate value for completing the cleaning within the above-mentioned length of time.

Timing to stop the developing liquid supply is set at an appropriate point of time between the stopping of supply and running out of the developing liquid for supply to the squeeze roller 6 completely.

A start of the cleaning operation of the second processing device 33 shown in FIG. 3(*a*) is set 1273 m sec later, that is a time required for the photoconductive belt 2 to pass through the processing device of 97 mm from a start of the operation of the first processing device 31.

Mixing of colors caused by cleaning operation in one and the same non-image area 51 needs less concerns, as the cleaning operation performed in the state shown in FIG. 3(*b*) is for removing the developer from the photoconductive belt 2 completely. And even if the cleaning operation is performed while the processing device is shifting, there is no problem to be effected by a possibility of the mixed of colors.

The cleaning operation in the second processing device 33 requires a same length of time of approximately 666 m sec to complete the cleaning of the photoconductive belt 2 as in the first processing device 31. The similar operation is repeated until reaching to the fourth processing device 37 within the cleaning time as mentioned above.

After finishing the cleaning state all the way to the fourth processing device 37 shown in FIG. 3(*a*) and shifting to the cleaning state at the lower step shown in FIG. 3(*b*), the processing devices are raised and shifted to the state shown in FIG. 3(*c*), again, after ensuring an appropriate cleaning time at the lower step.

In the state shown in FIG. 3(*c*), as the squeeze roller 6 rotating without drive thereof causes no damage to the photoconductive belt 2, there is no designation of non-image area or image area with regard to the rising position. Timing for starting a rising to the position again is determined after an appropriate period of time for cleaning the surface of the squeeze roller 6 sufficiently at the lower step.

In the event of re-rising, the rising operation is started sequentially from the fourth processing device 37 to the first processing device 33. Timing for the third processing device 35 to start rising is determined after the dirt on the squeeze roller 6 of the fourth processing device 37 is removed completely to the photoconductive belt 2, that is, approximately 1273 m sec before shifting to the lower step.

The above-mentioned timing is determined in order to prevent the dirt on the squeeze roller 6 to entrap into the fourth processing device 37. And the time period of 1273 m sec is required for performing the steps in which the third processing device 35 rises, the dirt on the squeeze roller 6 of the third processing roller 35 is removed to the photoconductive belt 2 and the dirt on the photoconductive belt 2 reaches to the squeeze roller 6 of the fourth processing device 37. Accordingly, it is necessary for the fourth processing device 37 to complete the shift to the lower step before the dirt of the third processing device 35 reaches thereto and to adjust the re-rising and re-falling satisfying the above-mentioned condition in the processing device later than the third processing device 35.

After the cleaning of the squeeze roller 6 at the upper step position and all the processing devices shifted in the standby state by completing the shift to the standby state at the lower step, voltage applied to the squeeze rollers 6 on are stopped concurrently. The timing for the stopping can be in one time or differed in each color by shifting to the standby state.

Figure 7:
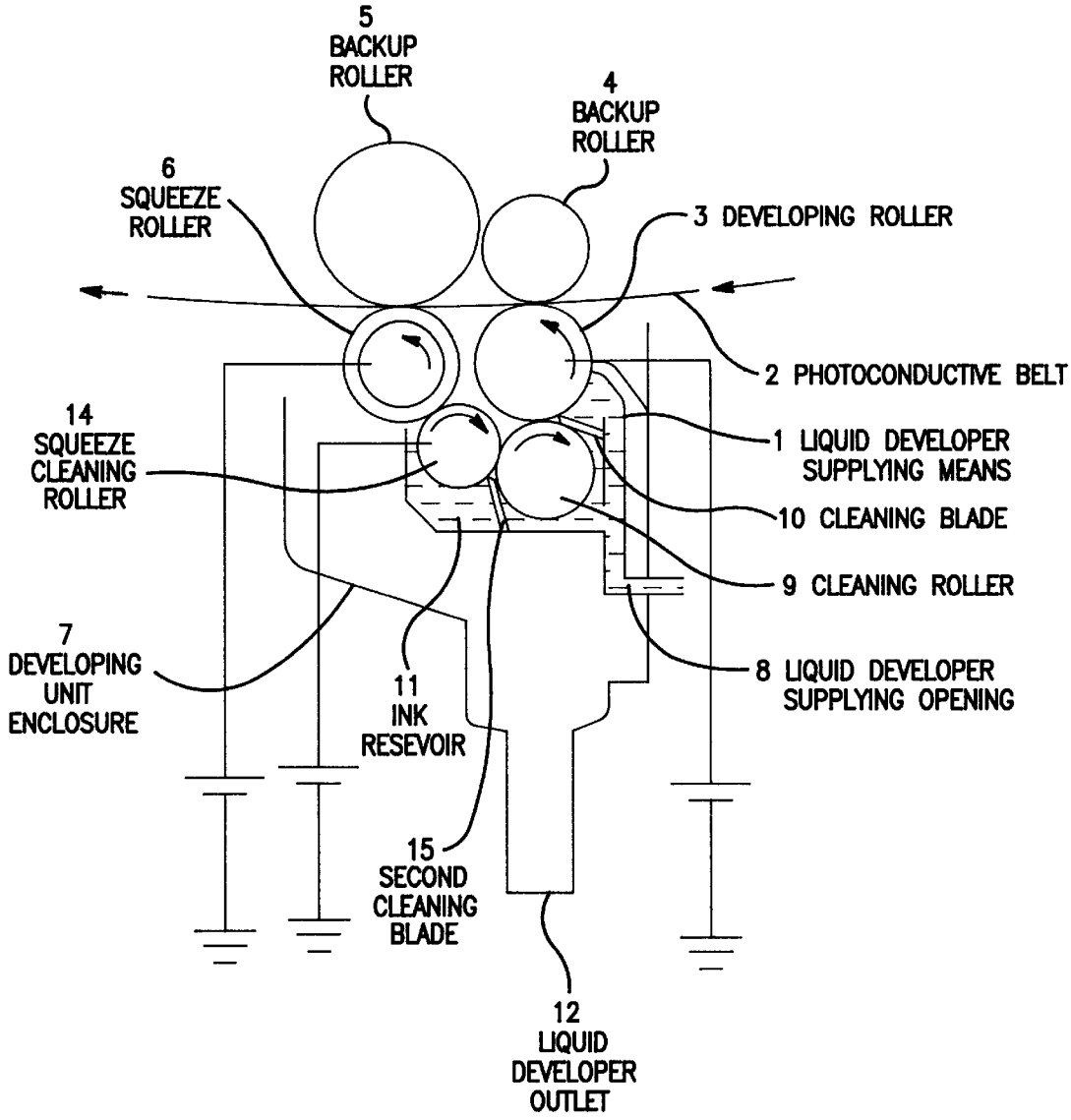
FIG. 7 is a model diagram of the processing device of a second embodiment, FIGS. 8(*a*) through (*d*) are diagrams for showing the processing device shifting to a standby state of the second embodiment.

Next, a second embodiment of the present invention is described. An overall composition is similar to the first embodiment a described in FIG. 1. FIG. 7 is a model diagram of a processing device of the second embodiment. A different point from the processing device of the first embodiment described in FIG. 2 is that a squeeze cleaning roller 14 is installed instead of the squeeze blade (FIGS. 2 13). Hereafter, the portion different from the first embodiment is described.

The squeeze cleaning roller 14 is in cylindrical shape consisting of metallic materials such as SUS (stainless), aluminum and the like -and placed having an gap of 0.15 mm with respect to the squeeze roller 6. And a cleaning roller 9 is pressed against both of the developing roller 3 and the squeeze cleaning roller 14 having a engaging depth of 1 through 2 mm. Direct current voltage is applied to the squeeze cleaning roller 14, which is set at a voltage 300 through 1200 V lower than the same applied to the squeeze roller 6.

A second cleaning blade 15 using a material with an elasticity is pressed with respect to the squeeze cleaning roller 14 by an end portion thereof and cleans the squeeze cleaning roller 14 after a cleaning by scraping a toner composition adhered to the surface thereof.

Figure 8B:
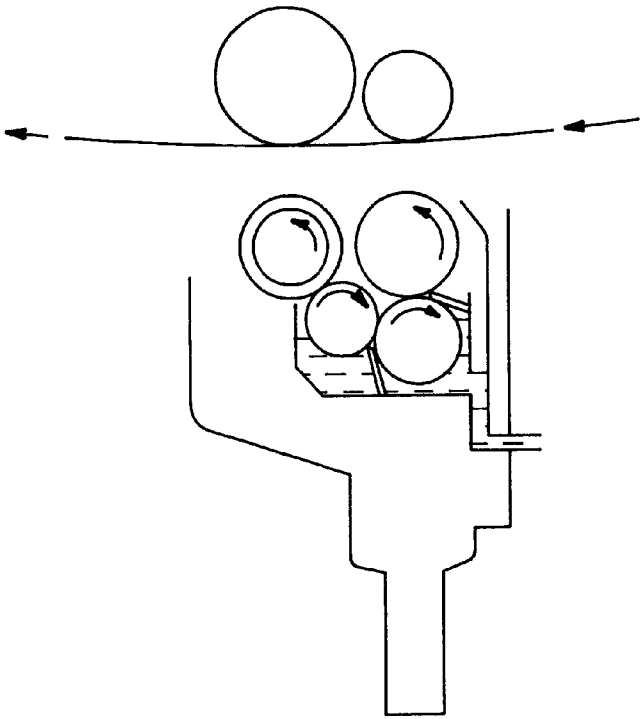
Figure 8A:
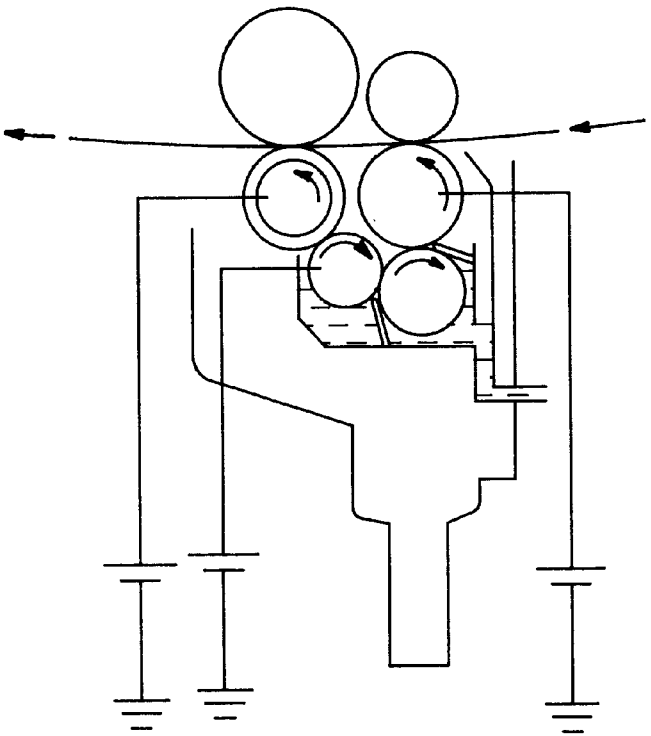

Next, the operation is described. FIG. 8 is a diagram for showing the processing device shifting to the standby state.

When a processing device shifts from a printing operation to a standby state, the cleaning operation is performed at a printing position (upper step position), as there is no mid step position comparing to the processing device of a squeeze blade installing type described in the first embodiment.

After finishing the printing operation, the processing device gets in the state of FIG. 8(*a*) and a supply of the developer is stopped. And after a period of time in which the supply of the developer to the squeeze roller 6 is actually stopped, the voltage applied to the squeeze roller 6 is switched the voltage set at 50 through 200 V higher than the voltage applied to the developing roller 3 during the printing operation to the voltage set at 50 through 1000 V lower than the voltage applied to the developing roller 3. This is a process to form an electric field in the direction of the squeeze roller 6 for removing the toner composition in the developer accumulated on the upstream side of the squeeze roller 6.

Figure 9:
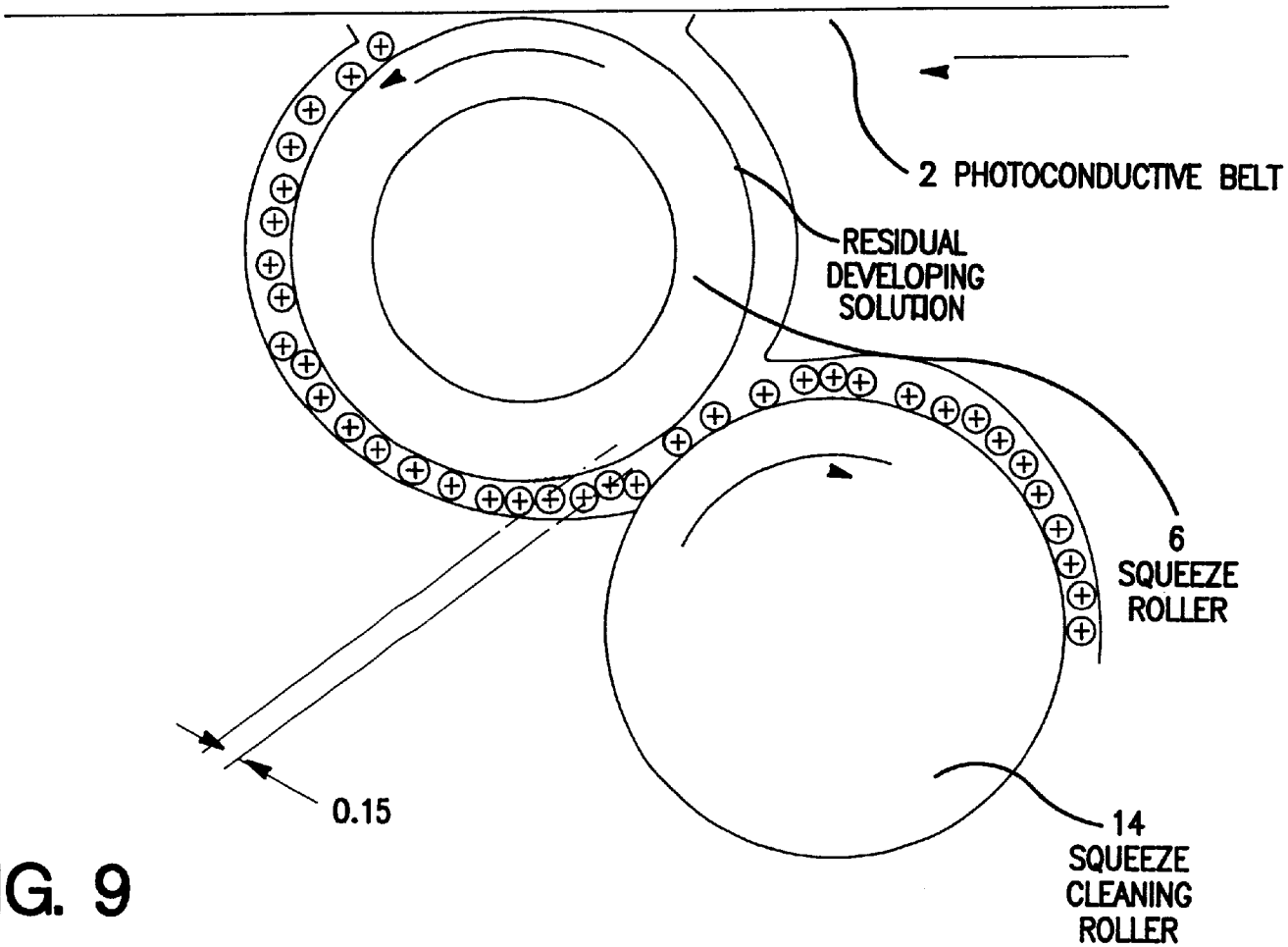
FIG. 9 is a model diagram for showing a cleaning state of the second embodiment and FIG. 10 is a model diagram of an operational sequence of the first embodiment.

Further, at the same timing as the switching of the applied voltage of the squeeze roller 6, the applied voltage of the squeeze cleaning roller 14 is switched to voltage at 300 through 1200 V lower than the switched voltage applied to the squeeze roller 6. This is a process to remove the toner adhered to the surface of the squeeze roller 6 by the cleaning to the squeeze cleaning roller 14. FIG. 9 is a model diagram for showing a situation when the toner is removed from the squeeze roller 6 to the squeeze cleaning roller 14. The toner removed to the squeeze cleaning roller 14 is scraped by a second cleaning blade and agitated further in the ink reservoir 11 to be re-conveyed to the developer storage not shown.

The toner composition in the developer accumulated on the upstream side of the squeeze roller 6 is removed to the side of the squeeze roller 6 and the processing device is shifted to the lower step when the toner composition in the developer is depressed sufficiently. The electrical insulating liquid including less toner composition remains on the photoconductive belt 2 and is recovered by a drying roller 38 shown in FIG. 1. The toner composition further remaining on the photoconductive belt 2 is transcribed by the transcribing roller 40 and recovered from the surface of the transcribing roller 40 by the cleaning element not shown.

After the processing device shifts to the lower step, a supply of the voltage applied to both of the squeeze roller 6 and the squeeze cleaning roller 14 is stopped. And after a period of time required for scraping the dirt from the surface of the squeeze cleaning roller 14 by the second cleaning blade 15, a rotation of the squeeze cleaning roller 14 and the voltage applied to each roller are stopped.

The above are the descriptions of the shifting operations of the processing device of single unit to the standby state.

Figure 10:
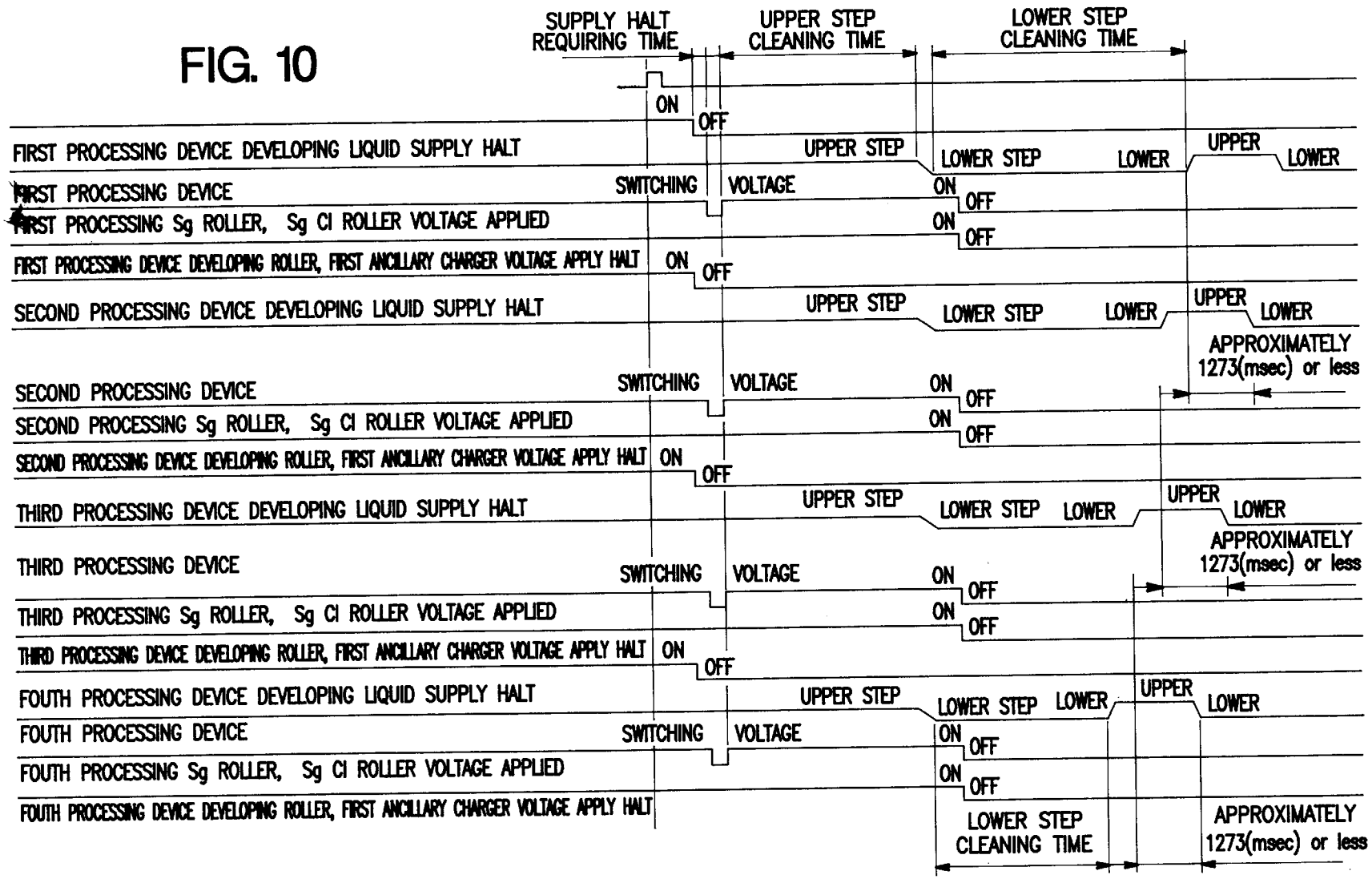

Next, an operational sequence of each processing device is described FIG. 10 is showing a sequence for shifting to the standby state. Though the supplies of developing solution are stopped concurrently in FIG. 10, it is also possible to stop the supplies by each processing device, in the event that the time for switching the operation to the cleaning state is equal to the time for stopping the supply of the developer completely.

After a certain period of time since the supply of the developing solution is stopped, the voltage applied to the squeeze roller 6 in each processing device are switched to the voltage applied to the squeeze cleaning roller 14.

Through the voltage are switched concurrently in FIG. 10. in the event of the above-mentioned condition is satisfied, the voltage can be switched concurrently or by each processing device.

After finishing the cleaning, the processing device is removed to the lower step position (the state of FIG. 8(*b*)), as shown in FIG. 10. Timing for shifting of the processing device are concurrent in FIG. 10. And shifting of the processing device from a position of the fourth processing device to the lower step position via a position of the first processing device 31 is also acceptable. A condition for shifting of the processing device to the lower step is that the processing device on the downstream side of the traveling direction of the photoconductive belt 2 completes the shifting to the lower step within 1273 m sec since the processing device which is an object of the shifting to the lower step started shifting.

After the supply of voltage applied to both of the squeeze roller 6 and the squeeze cleaning roller 14 is stopped at the lower step and the surface of the squeeze roller 14 is cleaned by rotating for a certain period of time, the rotation is stopped.

And after stopping the rotation, an operation for removing the dirt remaining on the squeeze roller 6 to the photoconductive belt 2 is started by raising the processing device again. The sequence of above-mentioned operation is similar to the sequence of the processing device of a squeeze blade installing type described in the first embodiment.

The operational sequence of the processing device of the squeeze cleaning roller 14 installing type has been described as above. Incidentally, it is not required to set a non-image area (FIG. 4 51), as the reverse rotation of the squeeze roller 6 is not performed in the second embodiment.

A first effect of the present invention is that a cleaning time at each processing device can be set without being affected by dirt produced and removed from an upstream side by raising the processing devices starting from the fourth processing device.

A second effect is preventing the residual dirt on a photoconductive belt from being entrapped in the processing device on a downstream side and causing a change in color and material value by retracting the processing devices from the fourth processing device on the downstream side, when the processing devices are separated from the photoconductive belt.

A third effect is that operations of four sets of the processing devices can be shifted to a standby states effectively without a loss of time, as an operation of a third processing device can be started during an operation of a fourth processing device by raising the processing devices sequentially from the fourth processing device to a first processing device in the direction of an upstream side of the traveling direction of the photoconductive belt, when the cleaning for removing the dirt on the surface of the squeeze roller to the photoconductive belt is performed. As the result, the present invention is capable of accelerate an average printing speed, in the event of receiving a requirement of printing at various length of intervals.

What is claimed is:

1. A liquid electro-photographic device comprising:

a photoconductor;

a plurality of processing devices for forming a multicolor image on said photoconductor;

a developing roller for supplying a liquid developer to said photoconductor; and a squeeze roller for removing a residual liquid developer from said multicolor image formed on said photoconductor, wherein at least one of said plurality of processing devices is movable so that said squeeze roller shifts from a first position having a clearance from said photoconductor, to a second position being pressed against said photoconductor for removing the residual liquid developer remaining on said photoconductor, and wherein said at least one of said plurality of processing devices is retracted, so that said squeeze roller shifts to the first position, the retraction proceeding sequentially from one of said plurality of processing devices on a downstream side of a traveling direction of said photoconductor.

2. The electro-photographic device as claimed in claim 1, wherein said one of said plurality of processing devices on a downstream side of a traveling direction of the photoconductor is retracted, before dirt of the liquid developer removed from a squeeze roller of another one of said plurality of processing devices on an upstream side of the traveling direction reaches to said one of said plurality of processing devices on the downstream side.

3. The electro-photographic device as claimed in claim 1, further comprising a squeeze blade for scraping off the residual liquid developer adhered to said squeeze roller.

4. The electro-photographic device as claimed in claim 3, wherein a first pressure of said squeeze roller against said photoconductor is less than a second pressure when said squeeze roller is in said first position, said squeeze blade contacting said squeeze roller for a period of time.

5. The electro-photographic device as claimed in claim 4, wherein a cleaning is performed by setting a non-image area unavailable for an image forming in said photoconductor and rotating said squeeze roller in a reverse direction against said photoconductor in said non-image area.

6. The electro-photographic device as claimed in claim 1, further comprising a squeeze cleaning roller for scraping off the liquid developer adhered to said squeeze roller.

7. The electro-photographic device as claimed in claim 6, further comprising a cleaning blade for scraping off the liquid developer adhered to said squeeze cleaning roller.

8. The electro-photographic device as claimed in claim 6, wherein voltage is applied to said developing roller, said squeeze roller and said squeeze cleaning roller and the voltage of said squeeze roller is set higher than said developing roller during the image forming operation while the voltage of said squeeze roller is set lower than said developing roller when the liquid developer adhered to said squeeze roller is cleaned off on finishing the image forming operation.

* * * * *